US006929148B2

(12) United States Patent
Haddad et al.

(10) Patent No.: US 6,929,148 B2
(45) Date of Patent: Aug. 16, 2005

(54) BATHROOM CADDY FOR DISPOSABLE WET WIPES

(76) Inventors: Philip Laracy Haddad, 105 Penwood Rd., Basking Ridge, NJ (US) 07920; Joseph Francis Haddad, 29 Sunset Pl., Millington, NJ (US) 07946

( * ) Notice: Subject to any disclaimer, the term of this patent is extended or adjusted under 35 U.S.C. 154(b) by 3 days.

(21) Appl. No.: 10/609,712

(22) Filed: Jun. 30, 2003

(65) Prior Publication Data

US 2005/0035141 A1 Feb. 17, 2005

(51) Int. Cl.[7] ..... B65H 1/00
(52) U.S. Cl. ..... 221/45; 271/283
(58) Field of Search ..... 221/45, 46, 63, 221/283, 199; 248/207, 214, 215, 339, 340; 242/588.3, 588.4, 588.6

(56) References Cited

U.S. PATENT DOCUMENTS 2,122,048 A * 6/1938 Shapiro ..... 206/494
2,685,365 A * 8/1954 Sieven ..... 206/410
2,790,608 A * 4/1957 Sieven ..... 242/596.3
3,837,595 A * 9/1974 Boone ..... 242/594.5
4,004,687 A * 1/1977 Boone ..... 206/233
4,106,616 A * 8/1978 Boone ..... 206/233
4,638,921 A * 1/1987 Sigl et al. ..... 221/1
5,192,044 A 3/1993 Baskin
5,348,168 A 9/1994 Emery
6,241,388 B1 6/2001 Terramani
6,546,572 B2 4/2003 Demonet

* cited by examiner

*Primary Examiner*—David H. Bollinger

(57) ABSTRACT

A dual arm caddy to be attached to the spindle of a wall mounted toilet paper holder for carrying disposable wet wipes. The upper portion of each arm is attached by hooking the spindle, and the lower, utility portion is attached to a container inclined from front to rear. A lid is rear-hinged. The hooking means can be a U-shaped slot open in the rear of the arm's upper portion, and inclined upward and elongated to assure the caddy makes wall contact before engaged spindle reaches slot's upper end. Embodiments include caddies suspendable from crossbars such as towel racks to provide consistently horizontal and stable utility platforms throughout a range of crossbar-to-wall distances.

3 Claims, 3 Drawing Sheets

BATHROOM CADDY FOR DISPOSABLE WET WIPES

BACKGROUND OF THE INVENTION

Disposable wet wipes have increasing use as a supplement to toilet paper. The objective of the primary embodiment of this invention is to make the wipes as conveniently available to the user as toilet paper now is. This objective is achievable by a caddy that shares the spindle of a wall mounted toilet paper holder, provided the caddy does not interfere with toilet paper use, occupies a minimal amount of space, and possesses good storage and accessibility features. These characteristics are attained by a low profile caddy that rests snugly and vertically against the wall for stability and space conservation regardless of spindle-to-wall distance.

Spindle-to-wall distances vary. Wall mounted holders are either recessed in the wall or attached to the surface of the wall. The spindle-to-wall distance of surface mounted holders is slightly more than 2.5 inches, the radius of a full roll of paper. With recessed holders the spindle itself can be nearly flush with the wall. Thus a commercially valuable caddy should rest vertically against the wall throughout approximately a 2.5 inch range of spindle-to-wall distances.

We believe caddies of our invention have the above characteristics and meet the stated objective.

SUMMARY OF THE INVENTION

The primary embodiment of this invention is a dual arm caddy for disposable wet wipes. The upper portion of each arm is hook-shaped and attachable to the spindle of a wall mounted toilet paper holder and the lower portion of the arms form brackets to which is attached a container for storing the wipes. For space conservation and ease of access the container is inclined from front to rear. A lid for moisture retention is rear hinged.

A feature of this invention is a means of engaging a spindle or other wall mounted crossbar, such as a towel rack, that allows the caddy to rest vertically against the wall throughout a range of crossbar-to-wall distances. The upper portion of each arm is a hook formed as a U-shaped slot that opens in the rear and is inclined upward and is sufficiently elongated to assure the caddy will make contact with the wall before the engaged crossbar reaches the upper end of the slot.

Other embodiments using this invention's attachment means are caddies that can be suspended from towel racks or other wall mounted crossbars to provide consistently horizontal and stable utility platforms for various purposes throughout a range of crossbar-to wall distances.

Figure 1:
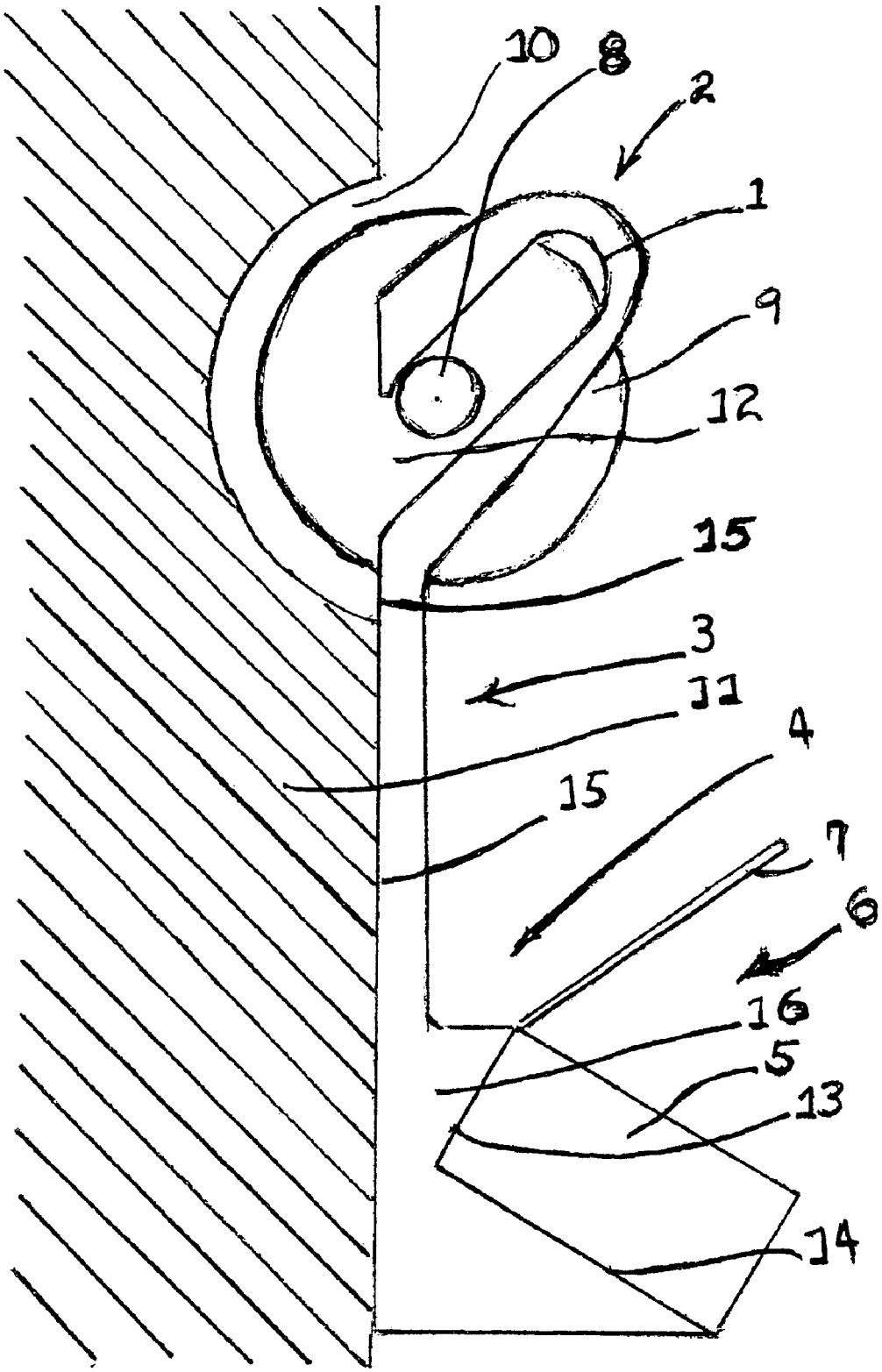
FIG. 1 is a side view of a caddy of this invention attached to spindle 8 of a toilet paper holder that is recessed 10 in a wall 11. Arm 3 has a mounting portion 2 at the upper end and a utility portion 4 at the lower end. The mounting portion is a hook formed as a U-shaped slot 1 with an opening 12 in the rear surface 15 of arm 3 mounting portion 2. Slot 1 inclines upward from opening 12 and traverses a lateral distance at least equivalent to the radius of a full roll of toilet paper 9. Spindle 8 is at the lower end of slot 1 retained by lip 17 which is aligned with the rear surface 15 of arm 3 which rests flush against wall 11. The forward facing surface 16 of utility portion 4 of arm 3 is attached to the back side 13 and bottom 14 of container 6. Hinged lid 7 is shown open.
Figure 2:
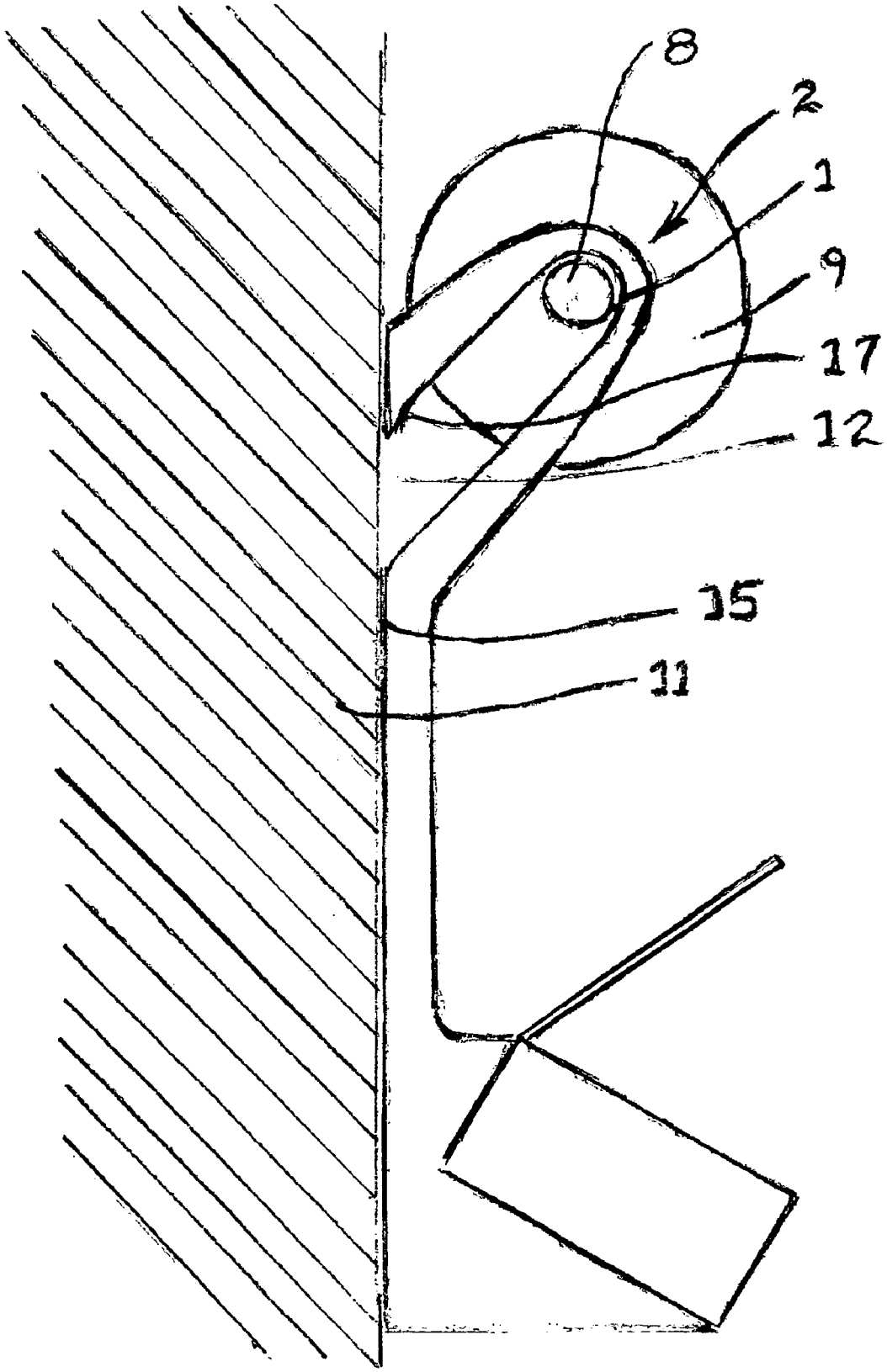
FIG. 2 shows a side view of the FIG. 1 caddy, however it is attached to the spindle 8 of a wall mounted toilet paper holder. The spindle-to-wall distance is slightly greater than the radius of the full roll of toilet paper 9. Spindle 8 is now located at the upper end of slot 1. The entire rear surface 15 of arm 3, including the lip 17 of opening 12 of slot 1, rests flush against wall 11.
Figure 3:
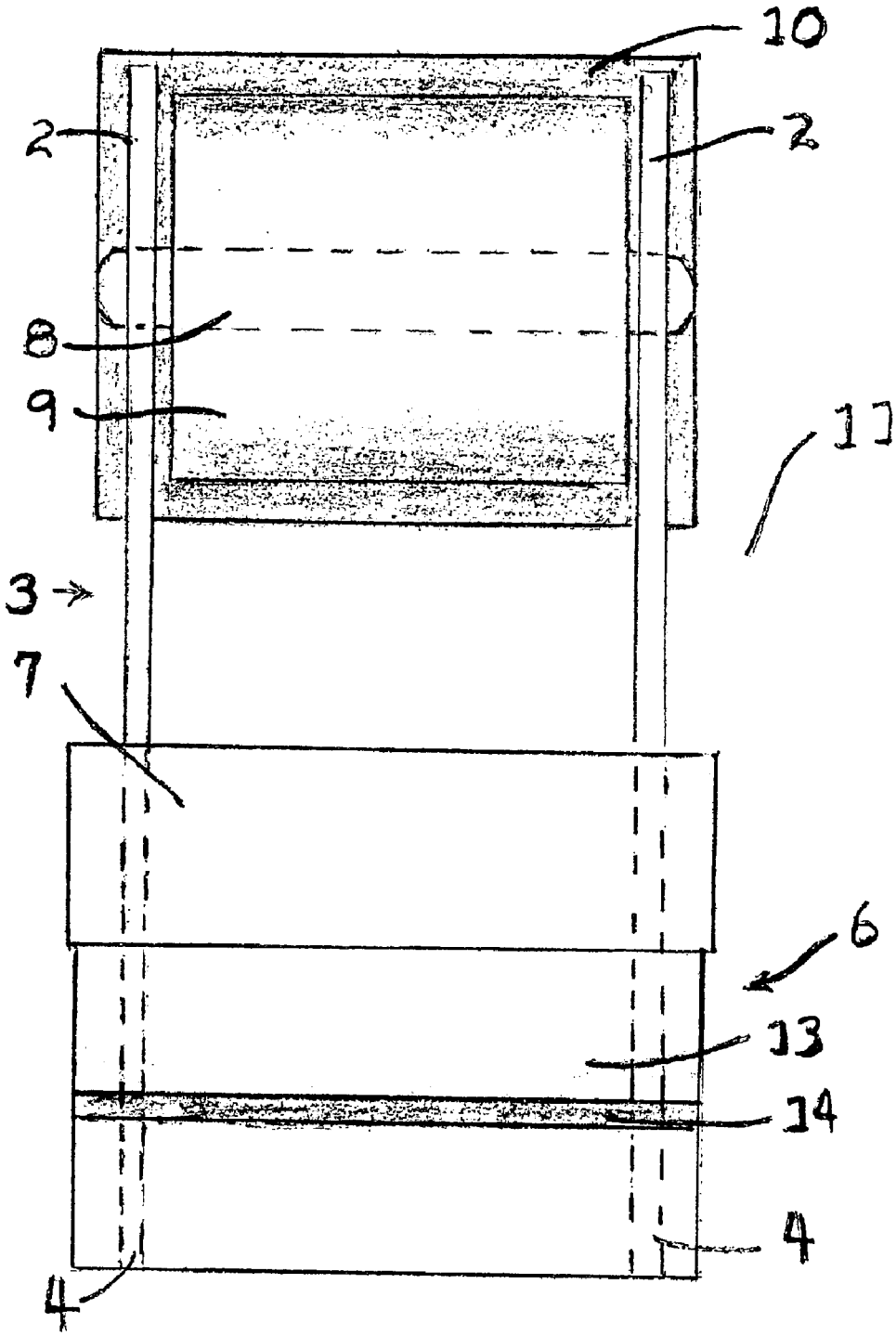
FIG. 3 is a front view of the caddy attached to spindle 8 of a holder that is recessed 10 in wall 11, as in FIG. 1. The mounting portion 2 of the arms 3 straddle the roll of toilet paper 9. A container 6 is attached to the utility portion 4 of both arms 3 in an inclined position with front side 16 lower than back side 13. Lid 7 is open providing a view of the back side 13 and bottom 14 of container 6. The utility portion 4 of the arms 3 is hidden from view.

We claim as follows:

1. A caddy, attachable to a spindle of a wall-mounted toilet paper roll holder, for storing and dispensing disposable wet wipes, and comprised of two arms, each having an upper, mounting portion and each having a lower, utility portion; each arm includes a front, room-facing, surface, and a back surface that faces the wall, and a) the mounting portion of each of said arms is configured as a hooking means, attachable to said spindle on opposites sides of a roll of toilet paper, and b) said front surface of the utility portion of said arms is attached to a container consisting of four sides including a front side and a back side, a bottom, and a top that includes a hinged lid, and c) wherein the forward surface of the utility portion of said arms is attached to said container and supports the container at a downward angle so that the front side of the container is lower than the back side.

2. A caddy, attachable to a spindle of a wall-mounted toilet paper roll holder, for storing and dispensing disposable wet wipes, and comprised of two arms, each having an upper, mounting portion and each having a lower, utility portion; each arm includes a front, room-facing, surface, and a back surface that faces the wall, and a) the mounting portion of each of said arms is configured as a hooking means, attachable to said spindle on opposites sides of a roll of toilet paper, and b) said front surface of the utility portion of said arms is attached to a container consisting of four sides including a front side and a back side, a bottom, and a top that includes a hinged lid, and c) wherein the hooking means of the mounting portion of each of said arms is a U-shaped slot having an opening in said back surface, and being upwardly inclined toward said front surface, and elongated sufficiently to traverse a horizontal distance at least equal to the distance of said spindle to said wall.

3. The caddy of claim 2 wherein said U-shaped slot is further configured as follows:

a) said U-shaped slot opening in the back surface is horizontally located to be aligned vertically with that portion of the back surface that rests flush to wall, b) said U-shaped slot opening is formed with an upper lip that extends downward to retain engaged spindle.

* * * * *